US010377141B2

(12) United States Patent
Cheng et al.

(10) Patent No.: US 10,377,141 B2
(45) Date of Patent: Aug. 13, 2019

(54) FIXING DEVICE, INKJET CARTRIDGE AND INKJET PRINTING APPARATUS

(71) Applicants: BOE Technology Group Co., Ltd., Beijing (CN); Hefei Xinsheng Optoelectronics Technology Co., Ltd., Hefei (CN)

(72) Inventors: Lu Cheng, Beijing (CN); Haitao Long, Beijing (CN); Feiji Zhou, Beijing (CN); Xiaodong Yang, Beijing (CN); Haitao Bai, Beijing (CN); Xu Xu, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 0 days.

(21) Appl. No.: 15/801,546

(22) Filed: Nov. 2, 2017

(65) Prior Publication Data

US 2018/0250945 A1 Sep. 6, 2018

(30) Foreign Application Priority Data

Mar. 2, 2017 (CN) ..... 2017 2 0197977 U

(51) Int. Cl.
*B41J 2/175* (2006.01)
*B41J 29/02* (2006.01)

(52) U.S. Cl.
CPC ..... *B41J 2/17536* (2013.01); *B41J 2/17523* (2013.01); *B41J 2/17533* (2013.01); *B41J 29/02* (2013.01)

(58) Field of Classification Search
CPC ..... B41J 2/17536; B41J 2/17523; B41J 2/17533; B41J 29/02
See application file for complete search history.

(56) References Cited

U.S. PATENT DOCUMENTS

2016/0355324 A1* 12/2016 Shen ..... B65D 85/24

* cited by examiner

*Primary Examiner* — Scott A Richmond
(74) *Attorney, Agent, or Firm* — Banner & Witcoff, Ltd.

(57) ABSTRACT

A fixing device, an inkjet cartridge and an inkjet printing apparatus are disclosed. The fixing device includes a case body. The case body includes a front end and a rear end and provided with at least one groove extending from the rear end to the front end, the at least one groove is provided with at least one clamper therein for fixing a work piece therein.

15 Claims, 6 Drawing Sheets

FIXING DEVICE, INKJET CARTRIDGE AND INKJET PRINTING APPARATUS

The present application claims priority to the Chinese Patent Application No. 201720197977.6 filed on Mar. 2, 2017, the entire disclosure of which is incorporated herein by reference as part of the present application.

TECHNICAL FIELD

Embodiments of the present invention relates to a fixing device, an inkjet cartridge and an inkjet printing apparatus.

BACKGROUND

In the product manufacturing technique process in which inkjet printing is required, the inkjet needle may need to be replaced for different manufacturing conditions. Current inkjet cartridges are usually entirely disposable cartridge, especially, the cassette body for accommodating the inkjet needle is of an integral configuration, such that when one of the inkjet needles is damaged, the whole cassette body needs to be replaced, rather than replacement for the damaged inkjet needle, thus resulting in cost wastage. Furthermore, when the current inkjet cartridge is disassembled or the cassette body with the inkjet needle needs to be replaced, the inkjet needle is prone to contact the operator, which may cause injury to the staffs, and at the same time, the inkjet needle may contact the foreign objects and may be contaminated, which influences the yield rate of product manufacture.

SUMMARY

Embodiments of the present invention provide a fixing device, an inkjet cartridge and an inkjet printing apparatus.

At least one of embodiments of the disclosure provides a fixing device, comprising: a case body, wherein the case body comprises a front end and a rear end and provided with at least one groove extending from the rear end to the front end, the at least one groove is provided with at least one clamper therein for fixing a work piece therein.

For example, the fixing device provided by at least one of embodiments of the disclosure further comprises: a front-end protective case coupled with the case body and arranged at the front end of the case body, wherein the front-end protective case is configured to accommodate a front end of the work piece.

For example, the fixing device provided by at least one of embodiments of the disclosure further comprises: a rear-end protective case coupled with the case body and arranged at the rear end of the case body.

For example, in the fixing device provided by at least one of embodiments of the disclosure, at least one of the front-end protective case and the rear-end protective case is coupled with the case body through snap coupling.

For example, in the fixing device provided by at least one of embodiments of the disclosure, the at least one clamper is a stopper.

For example, in the fixing device provided by at least one of embodiments of the disclosure, the at least one grooves is provided with at least two clampers comprising a first clamper and a second clamper, the first clamper is set to fix the work piece in a direction perpendicular to a plane where the case body is located; and the second clamper is set to fix the work piece in a direction parallel to the plane where the case body is located.

For example, in the fixing device provided by at least one of embodiments of the disclosure, the first clamper is configured to be moveable in the direction perpendicular to the plane where the case body is located; and/or the second clamper is configured to be moveable in the direction parallel to the plane where the case body is located.

For example, in the fixing device provided by at least one of embodiments of the disclosure, the case body is provided with a screw which is configured to drive the first clamper to move together.

For example, in the fixing device provided by at least one of embodiments of the disclosure, the second clamper is an elastic member, one end of the second clamper is fixed onto the case body, and other end of the second clamper is in contact with the work piece.

For example, in the fixing device provided by at least one of embodiments of the disclosure, a shape of the second clamper comprises arc-shape, and semi-circular shape.

For example, the fixing device provided by at least one of embodiments of the disclosure further comprises: an upper-end protective case, arranged at a side of the case body adjacent to the work piece and coupled with the case body.

For example, in the fixing device provided by at least one of embodiments of the disclosure, the upper-end protective case is coupled with the case body through snap coupling or screw coupling.

At least one of embodiments of the disclosure provides an inkjet cartridge, comprising: an ink storage tank, comprising at least one ink storage unit; a fixing device, comprising a case body, wherein the case body comprising a front end and a rear end and is provided with at least one groove extending from the rear end to the front end, the at least one groove is provided with at least one clamper therein for fixing at least one inkjet needle therein, wherein the fixing device is mounted onto the ink storage tank through the rear end.

For example, in the inkjet cartridge provided by at least one of embodiments of the disclosure, the at least one inkjet needle is mounted into the at least one groove of the fixing device, the at least one inkjet needle comprises a tip end and a tail end, wherein the tip end of the inkjet needle is located at the front end of the case body, while the tail end of the inkjet needle is located at the rear end of the case body.

For example, in the inkjet cartridge provided by at least one of embodiments of the disclosure, the at least one ink storage unit comprises a terminal in communication with the tail end of the inkjet needle.

At least one of embodiments of the disclosure provides an inkjet printing apparatus, comprising: a printer body; and the afore-mentioned inkjet cartridge, which is mounted onto the printer body.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
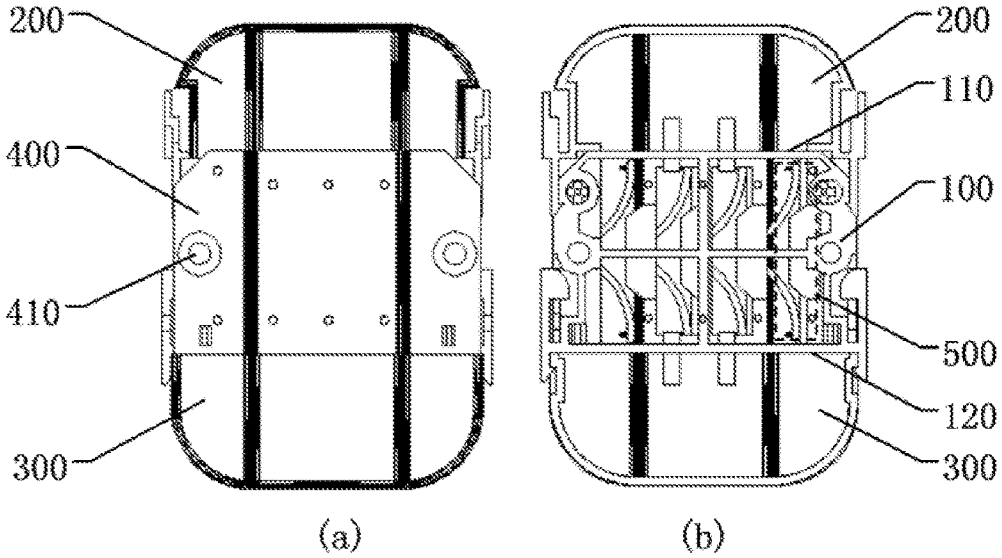
FIG. 1 is a structural schematic view of a fixing device provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Current inkjet cartridges, such as the inkjet cartridges of the inkjet apparatus used for manufacturing color filter substrates for the liquid crystal panel, would be provided with one protective housing to encase the portion by which the inkjet needle is fixed (for example, a device for fixing the inkjet needle), however, it is inconvenient to disassemble such a protective housing, and in the process of assembling the inkjet cartridge, it is readily to contact the operator's hands when disassembling the protective housing, thus causing contamination and the like. Furthermore, in the configuration of current inkjet cartridges, the inkjet needle is completely mounted into the inkjet cartridge. In the case where the inkjet needle is damaged and needs to be replaced, the entire inkjet cartridge or the portion by which the inkjet needle is fixed is replaced, it is impossible to replace only the damaged inkjet needles, thereby resulting in wastage and cost push.

At least one embodiment of the present disclosure provides a fixing device, an inkjet cartridge and an inkjet printing apparatus in order to solve at least the above technical matters. The fixing device comprises a case body, the case body has a front end, a rear end and is provided with at least one groove extending from the rear end to the front end. The at least one groove is provided therein with at least one clamper for fixing the work piece to be fixed (e.g., an elongate work piece, such as an inkjet needle) therein. The clamper is capable of fixing and disassembling the work piece by means of a control switch, and compared with the current fixing device, the fixing device provided by the embodiment of the present disclosure could realize the replacement for the work piece without replacing the entire fixing device, thus it is possible to avoid the situation where the entire fixing device needs to be replaced even when one of work pieces is damaged, and increase the work efficiency while reducing the manufacturing cost.

For example, the fixing device provided by at least one embodiment of the present disclosure may further comprise a front-end protective case coupled with the case body and provided at the front end of the case body. The front-end protective case could accommodate the front end of the work piece to be fixed. The front-end protective case provided at the front end of the case body could protect the work piece located at this location, so as to prevent the work piece from injuring the staffs and avoid the work piece from contamination caused by contacting the external objects. Moreover in practice, the case body and the front-end protective case may be placed separately, and then reconnected or assembled together as needed.

At least one embodiment of the present disclosure provides a fixing device, FIG. 1 is a structural schematic view of the fixing device provided by an embodiment of the present disclosure, in which FIG. 1 (*a*) is a top view, and FIG. 1(*b*) is a bottom view. In the fixing device according to an embodiment of the present disclosure, as illustrated in FIG. 1, for example, the fixing device comprises a case body 100, and the case body 100 comprises a front end 110 and a rear end 120. For example, in the fixing device provided by the embodiment of the present disclosure, as illustrated in FIG. 1, the fixing device may further comprise a front-end protective case 200, the front-end protective case 200 is coupled with the case body 100 and is provided at the front end 110 of the case body 100. FIG. 1 illustrates the configuration in which the case body 100 is coupled with the front-end protective case 200, in order to facilitate understanding of the specific structure of the fixing device, description will be made to the configurations of the case body 100 and the front-end protective case 200 separately, taking the case where the work piece to be fixed inside the case body 100 is an inkjet needle as an example.

Figure 2A:
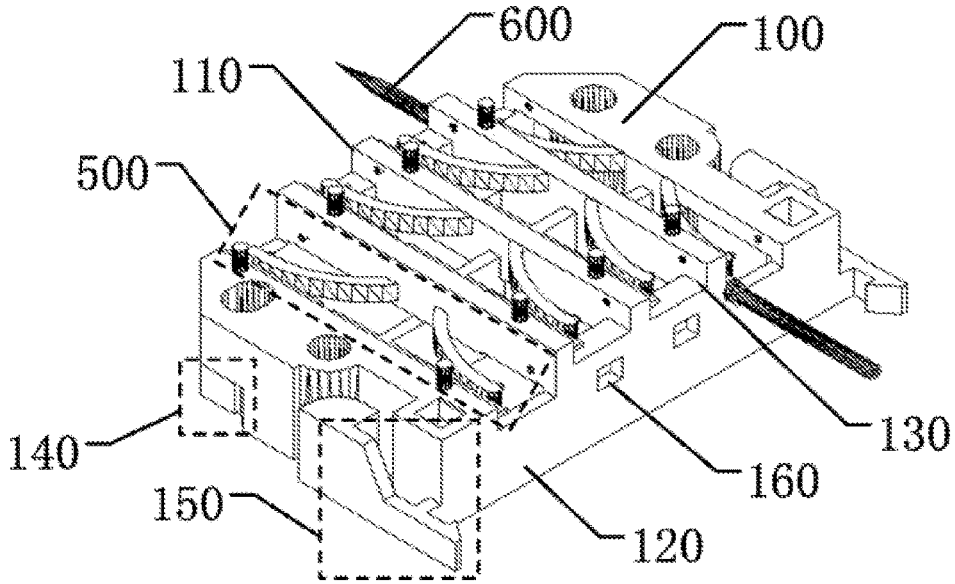
FIGS. 2*a* to 2*c* are structural schematic views of the case body of the fixing device of FIG. 1.
Figure 2B:
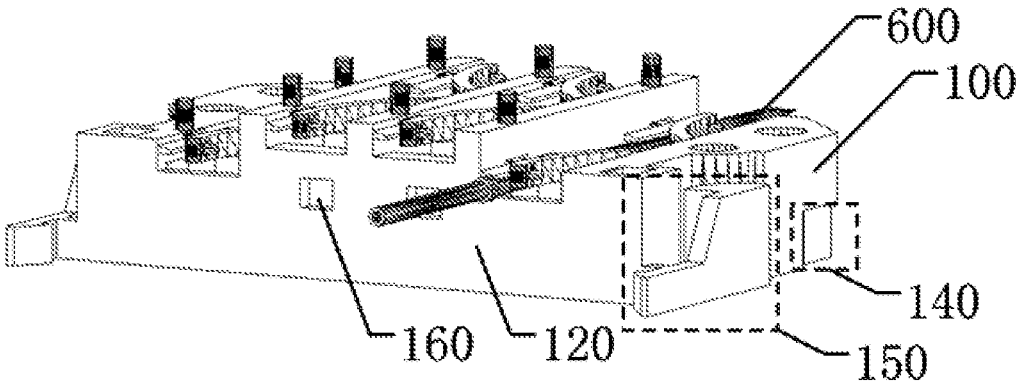
Figure 2C:
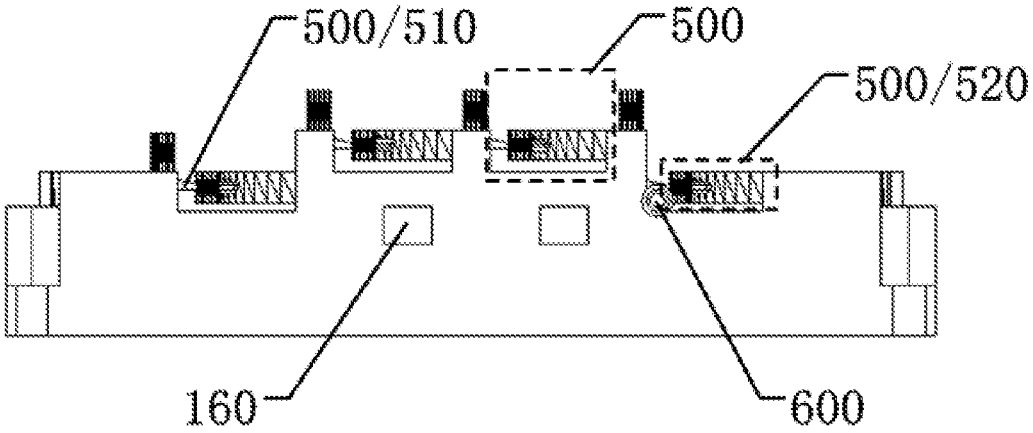

FIGS. 2*a* to 2*c* are structural schematic views of the case body in the fixing device as illustrated in FIG. 1. FIGS. 2*a* and 2*b* are perspective views of the case body, and FIG. 2*c* is a front view of the case body. As illustrated in FIGS. 2*a* to 2*c*, the case body 100 is provided with at least one groove 130 therein, and the groove 130 extends from the rear end 120 to the front end 110 of the case body 100. The groove 130 is provided with a clamper 500 therein to fix the inkjet needle 600 which is an example of the work piece. By opening and closing of the clamper 500, it is possible not only to fix the inkjet needle 600 in the groove 130, but also to make replacement for the inkjet needle 600 in each of the grooves 130. As an example, if one of the inkjet needles 600 in the case body 100 is damaged, the clamper 500 fixing the damaged inkjet needle 600 can be opened to release this inkjet needle 600. In comparison with the current fixing device, the fixing device provided by the embodiment of the present disclosure enables to make replacement for the damaged inkjet needle 600 in the case body, rather than requiring replace the entire fixing device, therefore, it is possible to reduce the production cost.

Figure 3:
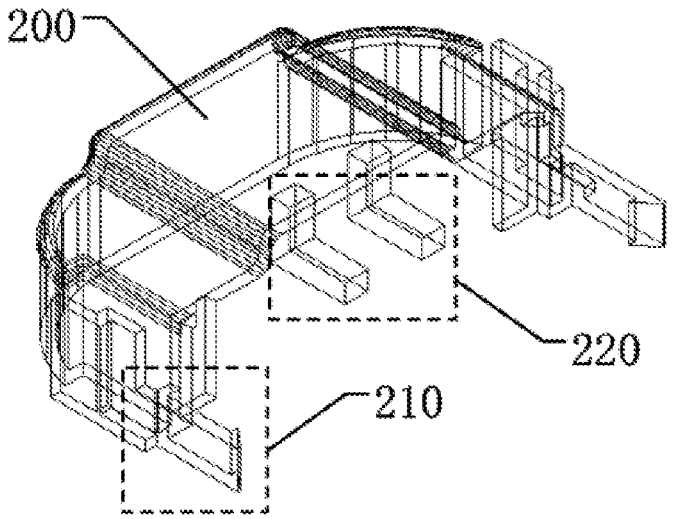
FIG. 3 is a structural schematic view of the front-end protective case in the fixing device of FIG. 1.

The front-end protective case could protect the work piece in the fixing device, therefore, the assembly between the front-end protective case and the case body is required to be stable, and at the same time, the front-end protective case can also be easily disassembled from the case body, so as to reduce the risk of the work piece being in contact with foreign objects while exposing the work piece. For example, in the embodiment of the present disclosure, the front-end protective case may be coupled with the case body in snap form. FIG. 3 is a structural schematic view of the front-end protective case in the fixing device as illustrated in FIG. 1, which is a perspective view. As illustrated in FIGS. 1 and 3, the front-end protective case 200 may be provided with a connector coupled with the case body 100, for example, a first front-end connecting portion 210, i.e., a cantilever having its end provided with snap protrusion. At the same time, as illustrated in FIG. 2*a*, a location of the case body 100 corresponding to the first front-end connecting portion 210 may be provided with a first body connecting portion 140, for example a snap recess which is engaged with the snap protrusion.

In order to ensure the stable attachment of the case body 100 with the front-end protective case 200, in the embodiment of the present disclosure, other connecting portions may be added to increase connecting positions. For example, the front-end protective case 200 may be further provided with a second front-end connecting portion 220, for example, a projection slab, and the location of the case body 100 corresponding to the second front-end connecting portion 220 may be further provided with a third body connecting portion 160, for example, a receptacle which is engaged with the projection slab.

In the embodiment of the present disclosure, the manner in which the case body 100 is coupled with the front-end protective case 200 is not restricted in the embodiments. For the purpose of easy disassembly, the two may be coupled together in snap manner. As illustrated in FIG. 3, the end of the first front-end connecting portion 210 on the front-end protective case 200 may be hook-shaped, and the recess of the first body connecting portion 140 on the case body 100 corresponding to the first front-end connecting portion 210 may have a shape complementary to the hook-shape, thereby achieving the coupling between the first front-end connecting portion 210 and the first body connecting portion 140. The second front-end connecting portion 220 on the front-end protective case 200 may be of a square columnar configuration, and the third body connecting portion 160 on the case body 100 corresponding to the second front-end connecting portion 220 may be a square receptacle having a certain depth, and the third body connecting portion 160 may be identical to the columnar section in shape and size. In this way, it is possible to achieve the coupling between the second front-end connecting portion 220 and the corresponding third body connecting portion 160, and the front-end protective case 200 may be coupled to the case body 100 in a flat insertion manner. As a result, it is possible to prevent the work piece from being contacted. The aforesaid connecting portion may be an elastic member and it may further have anti-slip property to prevent the front-end protective case 200 from slipping off the case body 100, for example, the connecting portion may be an anti-slip flexible rubber material.

It is noted that, the shapes of the aforesaid first front-end connecting portion 210, the first body connecting portion 140, the second front-end connecting portion 220 and the third body connecting portion 160 may be exchanged for each other, so long as it is possible to facilitate the assembly and disassembly of the front-end protective case 200 onto/from the case body 100 while the stable coupling between the case body 100 and the front-end protective case 200 can be ensured.

Figure 4:
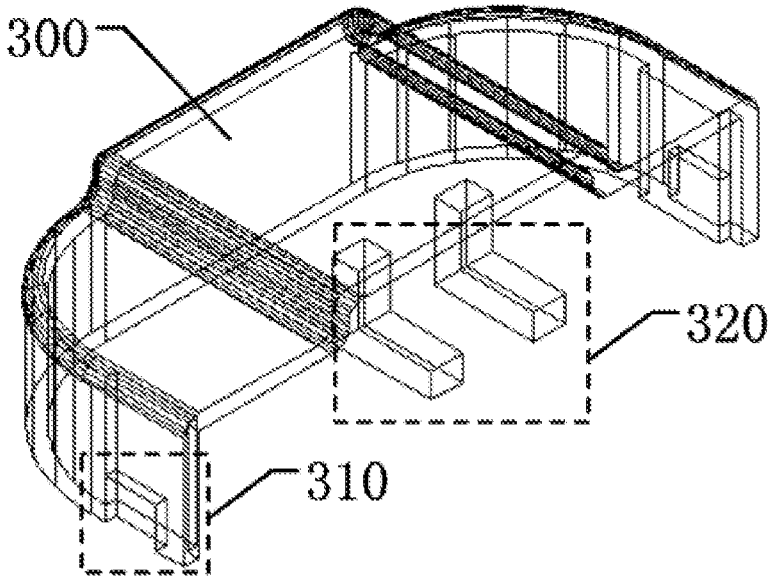
FIG. 4 is a structural schematic view of the rear-end protective case in the fixing device of FIG. 1.

For example, the fixing device provided by the embodiment of the present disclosure may further comprise a rear-end protective case, the rear-end protective case may be coupled to the case body and arranged at the rear end of the case body, in order to protect the case body and the part of the work piece located here. FIG. 4 is a structural schematic view of the rear-end protective case in the fixing device as illustrated in FIG. 1, which is a perspective view. As illustrated in FIGS. 1 and 4, the rear-end protective case 300 may be provided with a connector for coupling with the case body 100, for example, a first rear-end connecting portion 310, i.e., a cantilever having its end provided with a snap protrusion. At the same time, as illustrated in FIG. 2*a*, the location on the case body 100 corresponding to the first rear-end connecting portion 310 may be provided with a second body connecting portion 150, for example, a snap recess engaged with the snap protrusion. In order to ensure the stable attachment of the case body 100 and the rear-end protective case 300, in the embodiment of the present disclosure, other connecting portions may be added to increase connecting positions. For example, the rear-end protective case 200 may be further provided with a second rear-end connecting portion 320, for example a projection slab, and the location on the case body 100 corresponding to the second rear-end connecting portion 320 may be provided with a connecting portion, for example, a receptacle engaged with the projection slab (not shown, referring to the third body connecting portion 160).

In the embodiment of the present disclosure, the manner in which the case body 100 is coupled with the rear-end protective case 300 may refer to those of the case body 100 being coupled with the front-end protective case 200, thus, it is not elaborated here.

Figure 5:
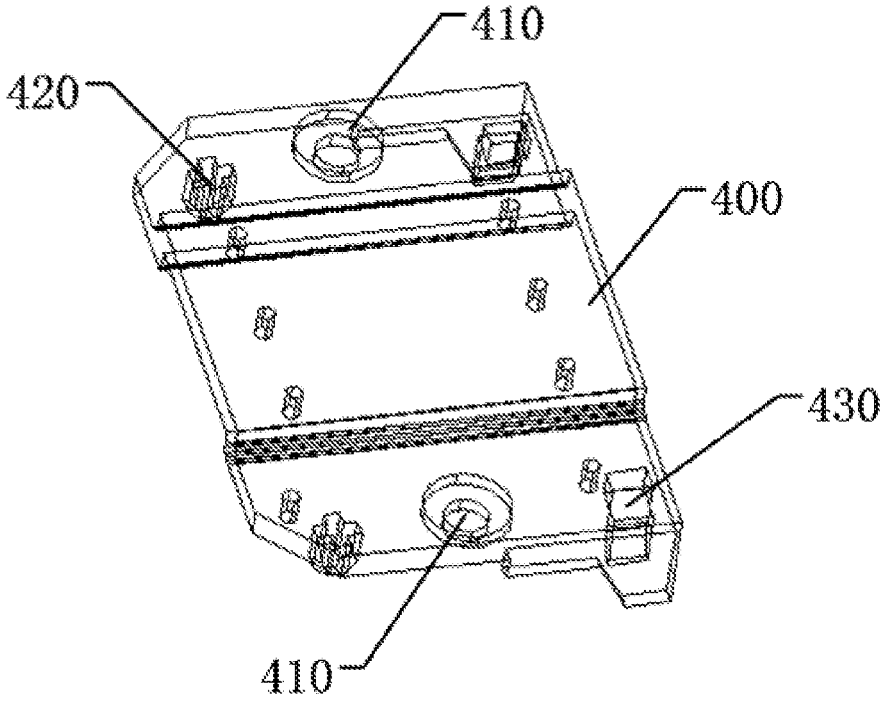
FIG. 5 is a structural schematic view of the upper-end protective case in the fixing device of FIG. 1.

For example, the fixing device provided by the embodiment of the present disclosure may further comprise an upper-end protective case, which is provided at a side of the case body adjacent to the work piece to be fixed, and is coupled with the case body. The upper-end protective case may protect the contents inside the case body, such as the work piece and the like. FIG. 5 is a structural schematic view of the upper-end protective case in the fixing device as illustrated in FIG. 1, which is a perspective view. For example, as illustrated in FIGS. 1 and 5, the upper-end protective case 400 may be coupled to the case body 100 by connecting portions, and the upper-end protective case 400 may be coupled to the case body 100 in various manners. In at least one example of the embodiment of the present disclosure, a description will be made to the coupling manner of the upper-end protective case 400 and the case body 100.

For example, in one example of the embodiment of the present disclosure, the upper-end protective case 400 may be provided with a first upper-end connecting portion 410. Unlike the front-end protective case 200 and the rear-end protective case 300, the upper-end protective case 400 is kept in fixing onto the case body 100 to protect the work piece therein and to secure the coupling between the case body 100 and the upper-end protective case 400. The first upper-end connecting portion 410 may be provided as a screw, the screw may run through the upper-end protective case 400 and the case body 100 to achieve a stable connection therebetween.

For example, in another example of the embodiment of the present disclosure, the upper-end protective case 400 may be provided with a second upper-end connecting portion 420 and/or a third upper-end connecting portion 430 thereon. In the process of replacing the work piece in the case body 100, for example, it is required to disassemble the upper-end protective case 400. For the convenience of disassembling the upper-end protective case 400, the second upper-end connecting portion 420 and/or the third upper-end connecting portion 430 may achieve the coupling between the upper-end protective case 400 and the case body 100 in snap manner, for example. The structure of the second upper-end connecting portion 420 and/or the third upper-end connecting portion 430 may refer to the connecting portion in the aforesaid front-end protective case 200, for example, the first front-end connecting portion 210, or refer to the connecting portion in the rear-end protective case 300, for example, the first rear-end connecting portion 310. Moreover, the coupling manner between the case body 100 with the upper-end protective case 400 may also refer to the coupling manner between the case body 100 and the front-end protective case 200 or the rear-end protective case 300, thus, it is not elaborated here.

It is noted that, the at least two coupling manners between the case body 100 and the upper-end protective case 400 in the above two examples may be mutually replaced and/or combined, and the specific selection may be determined according to actual requirement, there is no restriction in this regard.

In the embodiment of the present disclosure, the coupling between the case body and the front-end protective case, the rear-end protective case, or the upper-end protective case is not limited to the snap manner, so long as it is possible to facilitate the assembly and/or disassembly of the above structures.

For example, in the embodiment of the present disclosure, the clamper of the fixing device may be a stopper which may fix the work piece and achieve accurate positioning. For example, in the embodiment of the present disclosure, each of the grooves in the case body may be provided with at least two clampers therein, and the clampers cooperate with each other and may stop the inkjet needle, which is an example of the work piece, from different orientations, thereby preventing the work piece from moving. For example, each of the grooves may be provided therein with a first clamper and a second clamper, the first clamper is provided to fix the work piece in the direction perpendicular to the plane where the case body is located; and the second clamper is provided to fix the work piece in the direction parallel to the plane where the case body is located.

Figure 6:
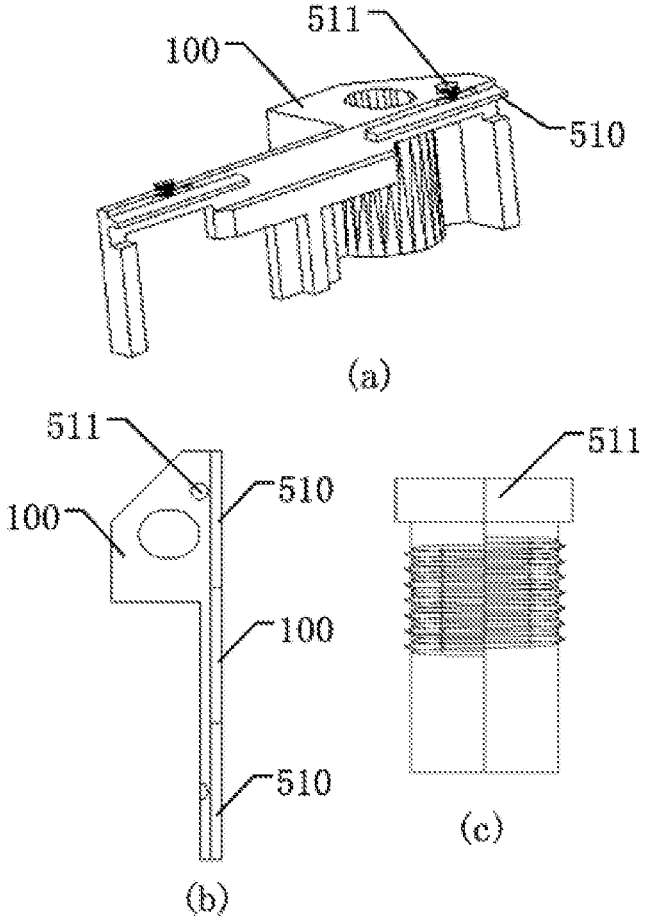
FIG. 6 is a structural schematic view of the first clamper in a fixing device provided by an embodiment of the present disclosure.

FIG. 6 is a structural schematic view of the first clamper in a fixing device provided by an embodiment of the present disclosure. FIG. 6(*a*) is a perspective view of the first clamper, FIG. 6(*b*) is a top view of the first clamper shown in FIG. 6(*a*), and to facilitate understanding of the connection relationship between the first clamper and the case body, both FIG. 6(*a*) and FIG. 6(*b*) illustrate a partial structure of the case body, the location where the first clamper is provided in the case body may refer to the clamper 500 shown in FIG. 2*c*. As illustrated in FIG. 2*c* and FIG. 6, the first clamper 510 may be provided at a side of the inkjet needle 600 away from the case body 100, as such the cooperation of the first clamper 510 with the case body 100 may fix the inkjet needle 600 in the direction perpendicular to the plane where the case body is located.

For example, in the embodiment of the present disclosure, as illustrated in FIG. 2*c* and FIG. 6, the first clamper 510 may be configured to be movable in the direction perpendicular to the plane where the case body 100 is located, as such, the space between the first clamper 510 and the case body 100 is adjustable. In this way, it is possible not only for the inkjet needle 600 to be fixed or loosened by the first clamper 510, but also to make the case body 100 to satisfy the requirement for assembling various types of inkjet needles 600. As illustrated in FIG. 2 (*a*), a rotating screw 511 may be provided on the case body 100, FIG. 2(*c*) is an enlarged view of the rotating screw 511 in FIG. 2 (*a*). For example, the rotating screw 511 may be fixed inside the case body 100, the first clamper 510 and part of the rotating screw 511 are provided with thread which matches with the thread of the rotating screw 511. When the rotating screw 511 rotates, it is possible to drive the first clamper 510 to move in the vertical direction. For example, the rotating screw 511 may also be set in such a way that it can be disengaged from or run into the case body 100 by rotation. The first clamper 510 may be fixed onto the rotating screw 511, as such, the first clamper 510 may also move simultaneously in the direction perpendicular to the plane where the case body 100 is located as the rotating screw 511 rotates.

It is noted that, in the embodiment of the present disclosure, there are a plurality of manners for moving the first clamper 510, using the screw 511 as described above is only one of them, the present disclosure has no restriction in this regard.

Figure 7:
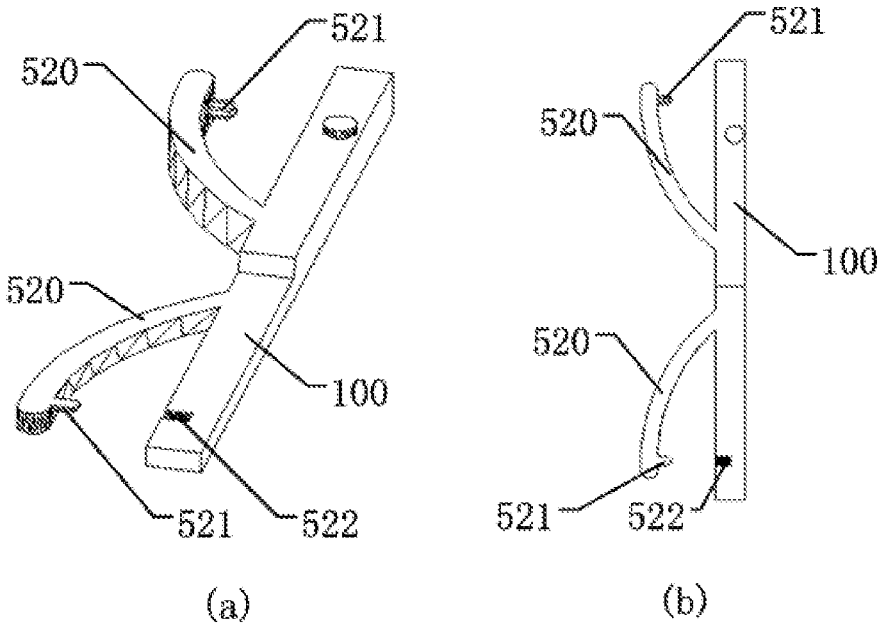
FIG. 7 is a structural schematic view of the second clamper of a fixing device provided by an embodiment of the present disclosure.

FIG. 7 is a structural schematic view of the second clamper of a fixing device provided by an embodiment of the present disclosure. FIG. 7 (*a*) is a perspective view of the second clamper, FIG. 7(*b*) is a top view of the second clamper shown in FIG. 7(*a*), in order to facilitate understanding of the connection relationship between the second clamper and the case body, both FIG. 7(*a*) and FIG. 7 (*b*) illustrate part of the structure of the case body, the location where the second clamper is provided in the case body may refer to the clamper 500 shown in FIG. 2*c*. As illustrated in FIG. 2*c* and FIG. 7, the second clamper 520 may be provided at a side of the inkjet needle 600 away from the case body 100 along the direction parallel to the case body 100, as such, the cooperation of the first clamper 510 with the case body 100 may fix the inkjet needle 600 in the direction parallel to the plane where the case body is located.

For example, in the embodiment of the present disclosure, as illustrated in FIG. 2*c* and FIG. 7, the second clamper 520 may be configured to be movable in the direction parallel to the plane where the case body 100 is located, as such, the space between the second clamper 520 and the case body 100 is adjustable. In this way, it is possible not only for the inkjet needle 600 to be fixed or loosened by the second clamper, but also to make the case body 100 to satisfy the requirement for assembling various types of inkjet needles 600. For example, in this embodiment, as illustrated in FIG. 2*c* and FIG. 7, the second clamper 520 may be an elastic member, and one end of the second clamper 520 may be fixed onto the case body 100, and the other end of the second clamper 520 may be in contact with the inkjet needle 600. Because the second clamper 520 may be an elastic member, the space between the second clamper 520 and the case body 100 is adjustable in the direction parallel to the plane where the case body 100 is located, that is, it is possible to satisfy the assembly of different types of inkjet needles 600.

For example, in the embodiment of the present disclosure, the part of the second clamper 520 contacting with the inkjet needle 600 may be set to be a flat plane, or set to have a surface matching with the shape of the inkjet needle 600. For example, the length of the contact part may be increased so as to enlarge the contact area therebetween. For another example, the surface of the second clamper 520 contacting with the inkjet needle 600 may be subject to an anti-slip treatment process, for example, by encasing the surface with anti-slip rubber, in this way, it is possible to increase fixing effect of the second clamper 520 upon the inkjet needle 600, thus preventing the inkjet needle 600 from sliding.

While the inkjet needle 600 of the fixing device needs to replace, the second clamper 520 continues to apply a force to the inkjet needle 600 because the second clamper 520 keeps in contact with the inkjet needle 600, as such in the case where the inkjet needle 600 is to be disassembled or assembled, inconvenience would be occurred. For example, in the embodiment of the present disclosure, in order to facilitate the separation of the second clamper 520 from the inkjet needle 600, the part of the second clamper 520 contacting with the inkjet needle 600 may be fixed onto the case body 100 in snap manner for example. As illustrated in FIG. 7, for example, a fixing protrusion 521 may be provided on the second clamper 520. For example, the fixing protrusion 521 may be provided at one end of the second clamper 520 adjacent to the inkjet needle 600 and at a side of the second clamper 520 away from the inkjet needle 600. Moreover, the case body 100 is provided with a fixing opening 522 at a location corresponding to the fixing protrusion 521 for fixing the fixing protrusion 521. For example, when the inkjet needle 600 needs to be disassembled, the fixing protrusion 521 may be pressed into the fixing opening 522 by pressing for example, in this way, the second clamper 520 is separated from the inkjet needle 600. After replacing the inkjet needle 600, the fixing protrusion 521 is again pulled out of the fixing opening 522, due to the fact that the second clamper 520 is an elastic member, the second clamper 520 can automatically fix the newly-assembled inkjet needle 600.

The shape of the second clamper may be an arc-shape, half annular shape, and the like. The present disclosure has no restriction thereto as long as the second clamper 520 may fix the inkjet needle 600 in the direction parallel to the plane where the case body 100 is located.

It is noted that, in the embodiment of the present disclosure, the arrangement of the clamper 500 is not limited to those in the aforesaid embodiments, as long as the clamper 500 may fix the inkjet needle 600 or it is also possible to facilitate the fixing and disassembling of the inkjet needle 600.

For example, in one example provided by the embodiment of the present disclosure, the clamper 500 may be a combination of barrier and spring, the barrier may contact with the inkjet needle 600, one end of the spring may be fixed onto the barrier, and the other end may be fixed onto the case body 100 or the upper-end protective case 400 for example. Due to the elastic property of the spring, the clamper 500 may not only fix the inkjet needle 600, but also facilitate the disassembling of the inkjet needle 600.

For example, in one example provided by the embodiment of the present disclosure, the clamper 500 may also be a member matching with the shapes of the groove 130 and the inkjet needle 600, such a member may be directly taken out of the groove 130. For example, when it is arranged into the groove 130, it may fix the inkjet needle 600 and is unlikely to move in the groove 130. The clamper 500 may be confined into the groove 130 by means of the upper-end protective case 400 for example.

To facilitate understanding the technical solution provided by the embodiment of the present disclosure, in one example of the embodiment of the present disclosure, a description will be made to the relationship among respective components of the fixing device through the operation process of replacing or assembling work pieces.

For example, in the present example, when it is required to assemble a new work piece into the apparatus, the operation process may comprises: disassembling the rear-end protective case of the fixing device, then assembling the rest of the fixing device to the apparatus, and then disassembling the front-end protective case of the case body. Since the front-end protective case may be coupled with the case body in snap manner for example, the operation of disassembling the front-end protective case is easy and simple, and the work piece fixed inside the case body would not be touched.

For example, in this example, when it is required to replace a single work piece in the fixing device, where the fixing device is mounted onto other apparatus for example, thus the front-end protective case and the rear-end protective case contained therein have been disassembled, the operation process may comprise: disassembling the fixing device from the apparatus, then disassembling the upper-end protective case coupled with the case body, opening the clamper configured for fixing the work piece to be replaced and then replacing the work piece, assembling the upper-end protective case onto the case body again, and then assembling the fixing device onto the apparatus, here the replacement for the work piece can be completed. It should be noted that, during the entire process from disassembling the fixing device to assembling the fixing device to the apparatus again, the front-end protective case is again assembled onto the fixing device as needed so as to prevent the work piece from being contaminated or injuring the staffs due to being touched.

At least one embodiment of the present disclosure provides an inkjet cartridge comprising an ink storage tank and the case body contained in the fixing device of the above embodiments. The ink storage tank may comprise at least one ink storage unit. The fixing device may comprise a case body, the case body has a front-end and a rear-end, and is provided with at least one groove extending from the rear-end to the front end. The at least one groove is provided with at least one clamper therein in order to fix the inkjet needle to be fixed therein. The fixing device may be mounted onto the ink storage tank through the rear end. The case body of the fixing device may be coupled to the ink storage tank so as to realize the communication between the inkjet needle of the case body and the ink storage unit. The ink storage tank may be coupled with the rear-end of the case body by using a connecting portion, and the configuration of the connecting portion may refer to the connection portion of the rear-end protective case provided in the above embodiments, so it is not elaborated here.

Figure 8:
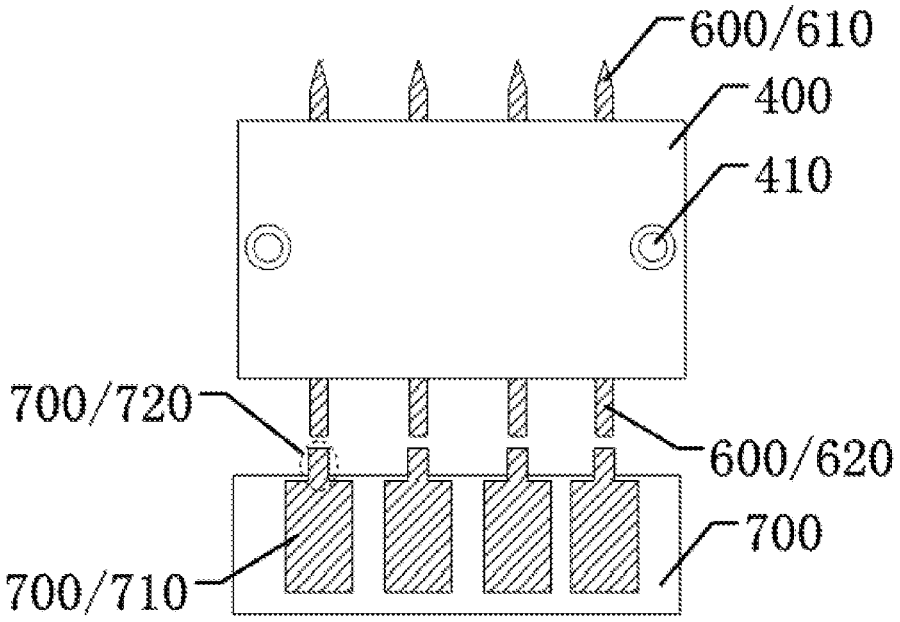
FIG. 8 is a structural schematic view of an inkjet cartridge provided by an embodiment of the present disclosure.

One embodiment of the present disclosure provides an inkjet cartridge, FIG. 8 is a structural schematic view of an inkjet cartridge provided by an embodiment of the present disclosure, which is a top view, wherein the case body 100 is not shown due to being shielded by the upper-end protective case 400. In this embodiment, the structure of the inkjet cartridge will be illustrated in conjunction with FIGS. 2*a* and 8. For example, as illustrated in FIGS. 2*a* and 8, the inkjet cartridge may comprise an ink storage tank 700 and the fixing device of any of the above embodiments. The ink storage tank 700 comprises at least one ink storage unit 710, and the fixing device at least comprises a case body 100. The case body 100 is configured to fix the inkjet needle 600, and the case body 100 is assembled onto the ink storage tank 700, thus realizing the fluid communication between the inkjet needle 600 and the ink storage unit 710. The specific structure of the case body 100 may refer to the contents with regard to the case body 100 provided by the aforesaid embodiments of the present disclosure, thus, it is not elaborated here.

For example, in the embodiment of the present disclosure, as illustrated in FIG. 2*a* and FIG. 8, the inkjet needle 600 comprises a tip end 610 and a tail end 620. The inkjet needle is mounted into at least one groove 130 of the fixing device. The tip end 610 of the inkjet needle corresponds to the front end 110 of the case body 100, and the tail end 620 of the inkjet needle corresponds to the rear end 120 of the case body 100. Each of the ink storage units 710 may comprise a terminal 720 communicated with the tail end 620 of the inkjet needle. The terminal 720 may protrude outside of the ink storage tank 700, or may be located inside the ink storage tank 700, as long as the terminal 720 may be stably communicated with the rear end 120 of the inkjet needle. For example, in the situation where the ink storage unit 710 is in communication with the rear end 120 of the inkjet needle through the terminal 720, for example, the ink in the ink storage unit 710 may be pushed into the inkjet needle under pressure.

In the inkjet cartridge provided by the embodiment of the present disclosure, the ink storage unit and the fixing device for fixing the inkjet needle are separated from each other, as such, in the case where the inkjet needle needs to be replaced, it is required to disassemble only the fixing device without the need to replace the entire inkjet cartridge, thus the cost can be saved. For example, in the inkjet cartridge provided by the embodiment of the present disclosure, the inkjet needle of the fixing device may be disassembled and replaced individually. In the case where one of the inkjet needles of the inkjet cartridge is damaged, it is required to disassemble the fixing device and then disassemble and replace the only damaged inkjet needle of the fixing device, without the need to replace the entire fixing device, thus saving the cost.

For example, in the embodiments of the present disclosure, the inkjet cartridge may be a mono-color inkjet cartridge or a multi-color inkjet cartridge, that is, the ink in the inkjet cartridge may be of one color or a plurality of colors. For example, the inkjet cartridge may be a four-color inkjet cartridge.

At least one embodiment of the present disclosure provides an inkjet printing apparatus, which comprises a printer body and the inkjet cartridge of any of the aforesaid embodiments of the present disclosure; the inkjet cartridge may be assembled onto the printer body.

For example, the inkjet printing apparatus may be applied to the process for manufacturing the color filter or repairing the color filter in the field of manufacturing display panels. For example, the inkjet cartridge may be a four-color inkjet cartridge. For example, the ink storage unit of the inkjet cartridge store black, yellow, blue and red colors of ink, and the case body may be provided with four grooves for four colors, each of which is provided with one inkjet needle. For example, the inkjet printing apparatus may also be applied to the inkjet printing process associated with the manufacturing of the display panel, for example, the inkjet printing manner may be utilized to manufacture the light emitting elements of the organic light emitting display panel.

The embodiments of the present disclosure provides a fixing device, an inkjet cartridge and an inkjet printing apparatus, and may have at least one of the following beneficial effects:

(1) The fixing device may fix the work piece (for example, the inkjet needle), and in the process of assembling the fixing device, it is easy to disassemble the protective case which is used to protect the work piece, e.g., the front-end protective case, thereby avoiding the work piece from being contact with foreign objects and thus being contaminated, while also reducing the risk that the work piece cause injury to the operators.

(2) The fixing device may realize individual replacement for the work piece, thus eliminating the need to replace the entire fixing device when the work piece is damaged, which would otherwise cause an increased cost.

The following statements should be noted:

(1) The accompanying drawings involve only the structure(s) in connection with the embodiment(s) of the present disclosure, and other structure(s) can be referred to common design(s).

(2) For the purpose of clarity only, in accompanying drawings for illustrating the embodiment(s) of the present disclosure, the thickness and a size of a layer or area may be enlarged or narrowed, that is, the drawings are not drawn in a real scale.

(3) In case of no conflict, features in one embodiment or in different embodiments can be combined as a new embodiment.

What is described above is related to the illustrative embodiments of the disclosure only and not limitative to the scope of the disclosure; the scopes of the disclosure are defined by the accompanying claims.

The present application claims the priority of Chinese Patent Application No. 201720197977.6 filed on Mar. 2, 2017, the disclosure of which is incorporated herein by reference in its entirety.

What is claimed is:

1. A fixing device, comprising:

a case body, comprising a front end and a rear end and provided with at least one groove extending from the rear end to the front end, the at least one groove is provided with at least two clampers therein for fixing a work piece therein, wherein the at least two clampers comprise a first clamper and a second clamper, the first clamper is set to fix the work piece in a direction perpendicular to a plane where the case body is located, and the second clamper is set to fix the work piece in a direction parallel to the plane wherein the case body is located.

2. The fixing device according to claim 1, further comprising a front-end protective case coupled with the case body and arranged at the front end of the case body, wherein the front-end protective case is configured to accommodate a front end of the work piece.

3. The fixing device according to claim 2, further comprising:

a rear-end protective case coupled with the case body and arranged at the rear end of the case body.

4. The fixing device according to claim 3, wherein at least one of the front-end protective case and the rear-end protective case is coupled with the case body through a snap coupling.

5. The fixing device according to claim 1, wherein the at least two clampers comprise a stopper.

6. The fixing device according to claim 1, wherein the first clamper is configured to be moveable in the direction perpendicular to the plane where the case body is located; and/or the second clamper is configured to be moveable in the direction parallel to the plane where the case body is located.

7. The fixing device according to claim 6, wherein the case body is provided with a screw which is configured to drive the first clamper to close.

8. The fixing device according to claim 6, wherein the second clamper is an elastic member, one end of the second clamper is fixed onto the case body, and other end of the second clamper is in contact with the work piece.

9. The fixing device according to claim 8, wherein a shape of the second clamper comprises an arc-shape, or a semi-circular shape.

10. The fixing device according to claim 1, further comprising:

an upper-end protective case, arranged at a side of the case body adjacent to the work piece and coupled with the case body.

11. The fixing device according to claim 10, wherein the upper-end protective case is coupled with the case body through a snap coupling or a screw coupling.

12. An inkjet cartridge, comprising:

an ink storage tank, comprising at least one ink storage unit; and a fixing device, comprising a case body, wherein the case body comprises a front end and a rear end and is provided with at least one groove extending from the rear end to the front end, the at least one groove is provided with at least two clampers therein for fixing at least one inkjet needle therein, wherein the fixing device is mounted onto the ink storage tank through the rear end, wherein the at least two clampers comprise a first clamper and a second clamper, the first clamper is set to fix the inkjet needle in a direction perpendicular to a plane where the case body is located, and the second clamper is set to fix the inkjet needle in a direction parallel to the plane where the case body is located.

13. The inkjet cartridge according to claim 12, wherein the at least one inkjet needle is mounted into the at least one groove of the fixing device, the at least one inkjet needle comprises a tip end and a tail end, wherein the tip end of the inkjet needle is located at the front end of the case body, while the tail end of the inkjet needle is located at the rear end of the case body.

14. The inkjet cartridge according to claim 13, wherein the at least one ink storage unit comprises a terminal in communication with the tail end of the inkjet needle.

15. An inkjet printing apparatus, comprising:

a printer body; and the inkjet cartridge according to claim 12, mounted onto the printer body.

* * * * *